United States Patent [19]

Rosenberg et al.

[11] Patent Number: 4,772,863

[45] Date of Patent: Sep. 20, 1988

[54] MICROWAVE FILTER EQUIPPED WITH MULTIPLY COUPLED CAVITY RESONATORS

[75] Inventors: Uwe Rosenberg, Allmersbach; Dieter Wolk, Korb, both of Fed. Rep. of Germany

[73] Assignee: ANT Nachrichtentechnik GmbH, Backnang, Fed. Rep. of Germany

[21] Appl. No.: 65,565

[22] Filed: Jun. 23, 1987

[30] Foreign Application Priority Data

Jun. 25, 1986 [DE] Fed. Rep. of Germany ..... 3621298

[51] Int. Cl.[4] ..... H01P 1/208; H01P 7/06

[52] U.S. Cl. ..... 333/212; 333/208; 333/230; 333/248

[58] Field of Search ..... 333/208, 209, 210, 211, 333/212, 248, 242, 227, 230, 134–136, 1

[56] References Cited

U.S. PATENT DOCUMENTS 3,969,692 7/1976 Williams et al. ..... 333/212

4,453,146 6/1984 Fiedziuzko ..... 333/212

FOREIGN PATENT DOCUMENTS 2285729 4/1976 France ..... 333/212

OTHER PUBLICATIONS

Galin–"A New Type Of Dual Mode Circular Cavity Filter", Microwave Journal, vol. 23, No. 10, Oct. 1980; pp. 92–93.

*Primary Examiner*—Marvin L. Nussbaum

*Attorney, Agent, or Firm*—Spencer & Frank

[57] ABSTRACT

A microwave filter composed of a plurality of cylindrical cavity resonators each having a side wall extending parallel to the direction of wave propagation in the resonator, wherein the cavity resonators are disposed with their side walls in contact with one another in a compact cylinder pack arrangement so that the side wall of each cavity resonator is in contact with the side wall of the maximum number of other mutually adjacent resonators, and coupling structures connecting resonators whose side walls are in contact, via the contacting side walls, for coupling electromagnetic energy between the resonators.

7 Claims, 1 Drawing Sheet

MICROWAVE FILTER EQUIPPED WITH MULTIPLY COUPLED CAVITY RESONATORS

BACKGROUND OF THE INVENTION

The present invention relates to a microwave filter equipped with a plurality of cavity resonators which are coupled with one another via coupling irises disposed in their side walls and extending parallel to the direction of wave propagation.

Such a microwave filter is disclosed in U.S. Pat. No. 3,969,692. To attain the highest possible filter quality (Q), all mutually coupled cylindrical cavity resonators of this microwave filter are operated in the TE-011 mode. In order to realize an elliptical filter characteristic, the cavity resonators of the prior art microwave filter are combined in a rather complicated arrangement in that, in addition to coupling together the cavity resonators which are arranged in succession in the direction of energy flow, positive or negative cross couplings are produced between other cavity resonators.

SUMMARY OF THE INVENTION

It is now an object of the present invention to provide a microwave filter of the above-mentioned type which is composed of a simple, compact cavity resonator structure that permits the largest number of couplings between individual cavity resonators.

The above and other objects are achieved, according to the invention, by a microwave filter composed of a plurality of cylindrical cavity resonators each having a side wall extending parallel to the direction of wave propagation in the resonator, wherein the cavity resonators are disposed with their side walls in contact with one another in a compact or dense cylinder pack arrangement with gaps of minimum size being formed between mutually adjacent resonators, and coupling means connecting resonators whose side walls are in contact, via the contacting side walls, for coupling electromagnetic energy between the resonators.

By arranging the cavity resonators in the manner of an extremely dense cylinder pack, there result the greatest possible number of contact zones which can be utilized for couplings. Moreover, the cavity resonator configuration according to the invention results in a space saving, compact microwave filter.

The invention will now be described in greater detail with reference to embodiments which are illustrated in the drawings.

DESCRIPTION OF THE PREFERRED EMBODIMENTS

Figure 1:
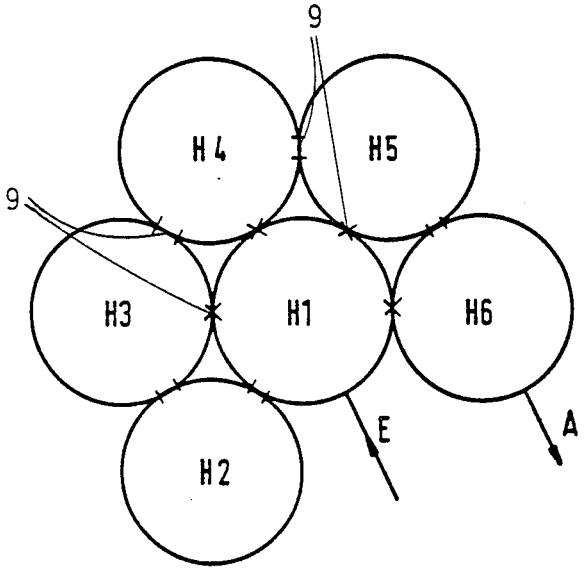
FIGS. 1 and 2 are pictorial views of two different cavity resonator configurations according to the invention.

FIG. 1 shows a microwave filter composed of six cylindrical cavity resonators H1 . . . H6 having circular cross sections. The cavity resonators are arranged in the manner of an extremely tight cylinder pack, with the side wall of each one of the cavity resonators lying adjacent the side walls of between two and five other cavity resonators. With this arrangement of cavity resonators H1 . . . H6, the largest possible number of mutual side wall contacts is realized. Via coupling irises 9 (e.g. holes, slits) in the side wall contact zones, a plurality of electromagnetic couplings can now be realized between adjacent cavity resonators.

Figure 2:
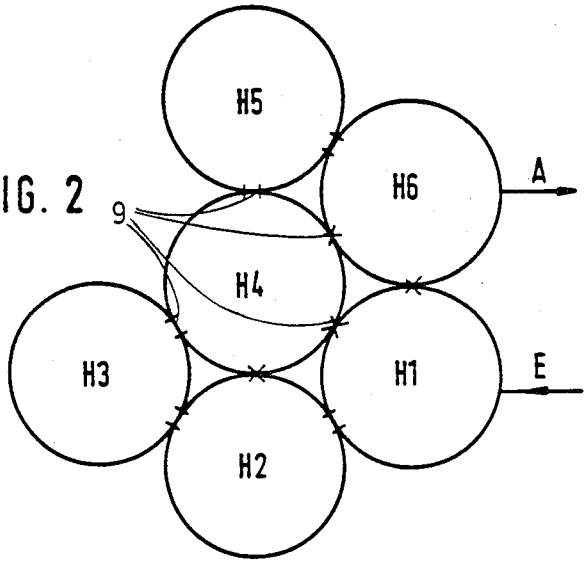

In the embodiment depicted in FIG. 1, major couplings indicated by parallel lines exist in the side wall contact zones between successive cavity resonators H1 . . . H6 which, beginning with cavity resonator H1 having a signal input E and ending with cavity resonator H6 having a signal output A are arranged in the direction of energy flow. In addition to these major couplings of the cavity resonators arranged in the direction of energy flow, there additionally exist secondary couplings (marked with the symbol x) between the central cavity resonator H1 and each of the cavity resonators H3, H4, H5 and H6 adjacent to it. A constellation of cavity resonators H1 . . . H6 which is modified slightly compared to that of FIG. 1 is shown in FIG. 2. Here, secondary couplings are provided between a centrally disposed cavity resonator H4 and cavity resonators H1, H2 and H6 which are not adjacent to it in the direction of signal flow, and a secondary coupling exists between the signal input cavity resonator H1 and the signal output cavity resonator H6.

The arrangement of the cavity resonators in the manner of an extremely tight cylinder pack permits a large number of variations in the arrangement of the cavity resonators to be coupled together. Moreover, a microwave filter constructed in this manner can be easily and inexpensively expanded into a more complex filter structure by adding further cavity resonators.

The above-described secondary couplings between adjacent cavity resonators which are not successive in the direction of energy flow can be realized either as positive or negative couplings.

Figure 3:
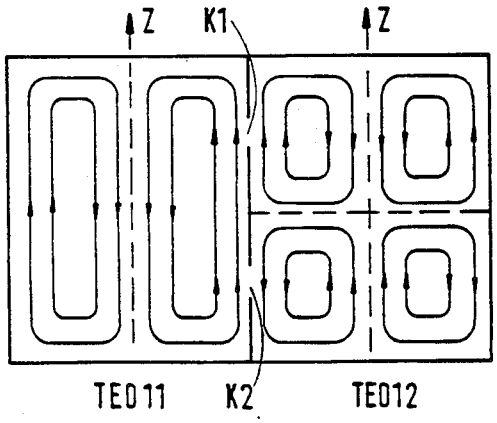
FIG. 3 is a pictorial view depicting wave modes existing in the cavity resonators of FIGS. 1 and 2.

FIG. 3 illustrates one manner in which two adjacent cavity resonators can be coupled either positively or negatively. For this purpose, the TE-011 mode exists in the left-hand one of the two adjacent cavity resonators, shown in FIG. 3 in a longitudinal sectional view parallel to the direction of wave propagation z, and the TE-012 mode exists in the other adjacent cavity resonator. In one region where the side walls of the two cavity resonators are adjacent one another, the magnetic field lines of the TE-011 mode and of the TE-012 mode are parallel to one another in the same direction. A coupling iris K1 disposed there permits a positive coupling between the cavity resonators. In another region of the adjacent side walls, the magnetic field lines of the TE-011 mode extend in the opposite direction to those of the TE-012 mode. A coupling iris K2 provided in the side wall at that location provides a negative coupling.

If, for example, a microwave filter according to FIG. 1 were realized which has positive primary couplings of its cavity resonators H1 . . . H6 following one another in the direction of energy flow and negative secondary couplings between cavity resonators H1, H4 and cavity resonators H1, H6, an elliptical filter characteristic would be obtained which has two pairs of genuine zero positions of the sixth order and a filter (Q) of 15,000 at 12 GHz.

One embodiment of the above described filter is designed for a center frequency of 12.5 GHz, in which case the cavity resonators H1 . . . H6 and the slit-shaped coupling irises 9 in the side walls of the resonators are dimensioned as follows:

Each of the cavity resonators H1 . . . H6 has a diameter of 34 mm and a length of 22.5 mm. The input-coupling-slit in the side wall of resonator H1 and the output-coupling-slit in the side wall of resonator H6 have a dimension of 9.1 mm×3 mm (length×width). The major coupling-slits (marked with the symbol | |) in the side wall contact zones between successive resonators have the following dimensions:

H1⟷H2: 7.8 mm×2 mm (length×width)
H2⟷H3: 7.3 mm×2 mm
H3⟷H4: 7.2 mm×2 mm
H4⟷H5: 7.3 mm×2 mm
H5⟷H6: 7.8 mm×2 mm The secondary coupling-slits (marked with the symbol x) between the central resonator and each of the resonators adjacent to it have the dimension of 4.3 mm×2 mm.

The invention now being fully described, it will be apparent to one of ordinary skill in the art that many changes and modifications can be made thereto without departing from the spirit or scope of the invention as set forth herein.

What is claimed is:

1. A microwave filter comprising a plurality of cylindrical cavity resonators each having a side wall extending parallel to the direction of wave propagation in said resonator, with said cavity resonators being disposed with their side walls in contact with one another in a compact cylinder pack arrangement with gaps of minimum size being formed between mutually adjacent resonators, and respective coupling means connecting resonators whose side walls are in contact, via the contacting side walls, for coupling electromagnetic energy between said resonators; and wherein: one of two adjacent said resonators which are connected by a respective said coupling means propagates energy in a first mode having field lines which extend in a first sense in the direction of propagation adjacent said side wall of said one resonator, and the other of said two resonators propagates energy in a second mode having field lines which are directed in the first sense in the direction of propagation adjacent a first portion of said side wall of said other resonator and which are directed opposite to the first sense in the direction of propagation adjacent a second portion of said side wall of said other resonator, whereby a respective said coupling means connected to said first portion of said side wall of said other resonator produces a positive coupling between said two adjacent said resonators and a respective said coupling means connected to said second portion of said side wall produces a negative coupling between said two adjacent said resonators; and the first mode is the TE-011 mode and second mode is the TE-012 mode.

2. A microwave filter as defined in claim 1 wherein said coupling means are connected to said first portion of said side wall of said other resonator to produce a positive coupling.

3. A microwave filter as defined in claim 1 wherein said coupling means are connected to said second portion of said side wall of said other resonator to produce a negative coupling.

4. A microwave filter comprising a plurality of cylindrical cavity resonators each having a side wall extending parallel to the direction of wave propagation in said resonator, with said cavity resonators being disposed with their side walls in contact with one another in a compact cylinder pack arrangement with gaps of minimum size being formed between mutually adjacent resonators, and respective coupling means connecting resonators whose side walls are in contact, via the contacting side walls, for coupling electromagnetic energy between said resonators; and wherein: one of two adjacent said resonators which are connected by a respective said coupling means propagates energy in a first mode having field lines which extend in a first sense in the direction of propagation adjacent said side wall of said one resonator, and the other of said two resonators propagates energy in a second mode having field lines which are directed in the first sense in the direction of propagation adjacent a first portion of said side wall of said other resonator and which are directed opposite to the first sense in the direction of propagation adjacent a second portion of said side wall of said other resonator, whereby a respective said coupling means connected to said first portion of said side wall of said other resonator produces a positive coupling between said two adjacent said resonators and a respective said coupling means connected to said second portion of said side wall produces a negative coupling between said two adjacent said resonators; and a first one of said resonators is connected to a signal input, a second one of said resonators is connected to a signal output, all of said resonators are connected to effect energy flow through all of said resonators in a selected sequence from said first resonator to said second resonator, and said coupling means connect said resonators so that a positive coupling exists between resonators connected to one another in the selected sequence and a negative coupling exists between two of said resonators which are separated from one another in the selected sequence.

5. A microwave filter as defined in claim 4 wherein said side wall of one of said resonators contacts said side wall of every other said resonator.

6. A microwave filter as defined in claim 5 composed of at least four resonators.

7. A microwave filter as defined in claim 5 including at least six of said resonators with said side wall of each said resonator contacting the side wall of at least two other of said resonators.

* * * * *